US012385640B2

(12) United States Patent
Ito et al.

(10) Patent No.: US 12,385,640 B2
(45) Date of Patent: Aug. 12, 2025

(54) COMBUSTION DEVICE AND GAS TURBINE SYSTEM

(71) Applicant: IHI Corporation, Tokyo (JP)

(72) Inventors: Shintaro Ito, Tokyo (JP); Masahiro Uchida, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 18/780,689

(22) Filed: Jul. 23, 2024

(65) Prior Publication Data

US 2024/0377065 A1 Nov. 14, 2024

Related U.S. Application Data

(63) Continuation of application No. PCT/JP2022/043049, filed on Nov. 21, 2022.

(30) Foreign Application Priority Data

Jan. 31, 2022 (JP) ..... 2022-013189

(51) Int. Cl.
*F23R 3/00* (2006.01)

(52) U.S. Cl.
CPC ..... *F23R 3/002* (2013.01)

(58) Field of Classification Search
CPC .. F23R 3/002; F23R 3/286; F23R 3/14; F23D 14/24
See application file for complete search history.

(56) References Cited

U.S. PATENT DOCUMENTS

| | | | | |
|---|---|---|---|---|
| 3,844,484 | A * | 10/1974 | Masai | F23D 11/107 239/404 |
| 11,859,822 | B2 * | 1/2024 | Fukuba | F23D 14/04 |
| 2011/0247338 | A1 | 10/2011 | Bottcher et al. | |
| 2012/0036856 | A1 | 2/2012 | Uhm et al. | |
| 2016/0010864 | A1 | 1/2016 | Abe et al. | |
| 2017/0074521 | A1 * | 3/2017 | Horikawa | F23R 3/286 |
| 2021/0180518 | A1 * | 6/2021 | Koganezawa | F23R 3/16 |
| 2023/0167976 | A1 * | 6/2023 | Karishuku | F23R 3/343 60/739 |
| 2023/0358404 | A1 * | 11/2023 | Kubiak | F23R 3/283 |
| 2024/0328625 | A1 * | 10/2024 | Nagahashi | F23R 3/46 |

FOREIGN PATENT DOCUMENTS

| | | | |
|---|---|---|---|
| JP | 2012-042194 | A | 3/2012 |
| JP | 2012-511687 | A | 5/2012 |
| JP | 2015-014400 | A | 1/2015 |
| JP | 2017-072271 | A | 4/2017 |
| JP | 2019-138560 | A | 8/2019 |
| JP | 6804755 | B2 | 12/2020 |
| WO | 2014/141397 | A1 | 9/2014 |
| WO | 2015/182727 | A1 | 12/2015 |

* cited by examiner

*Primary Examiner* — Devon C Kramer
*Assistant Examiner* — Rodolphe Andre Chabreyrie

(57) ABSTRACT

A combustion device includes: a burner plate facing a combustion chamber; a plurality of injection hole groups formed in the burner plate so as to have an annular shape; and a slit having an annular shape and formed between the plurality of injection hole groups.

8 Claims, 11 Drawing Sheets

COMBUSTION DEVICE AND GAS TURBINE SYSTEM

CROSS REFERENCE TO RELATED APPLICATIONS

This application is a continuation application of International Application No. PCT/JP2022/043049, filed on Nov. 21, 2022, which claims priority to Japanese Patent Application No. 2022-013189 filed on Jan. 31, 2022, the entire contents of which are incorporated herein by reference.

BACKGROUND ART

Technical Field

The present disclosure relates to a combustion device and a gas turbine system.

A gas turbine system that combusts fuel in a combustor to obtain power has been used. As the gas turbine system, for example, there exists a gas turbine system that uses hydrogen as fuel, as disclosed in Patent Literature 1. Emission of carbon dioxide is suppressed by using hydrogen as fuel.

CITATION LIST

Patent Literature

Patent Literature 1: JP 2015-014400 A

SUMMARY OF INVENTION

Technical Problem

In recent years, in a gas turbine system, a plate facing a combustion chamber, in which hydrogen is burned, is manufactured using additive manufacturing technology in some cases. In such cases, a metal lamination amount of the plate on the combustion chamber side is larger than a metal lamination amount of the plate on a side opposite to the combustion chamber. As a temperature of the metal laminated during manufacture of the plate decreases, the metal shrinks. At this time, the plate may deform to the combustion chamber side due to a shrinkage force on the side with the larger metal lamination amount.

An object of the present disclosure is to provide a combustion device and a gas turbine system that are capable of suppressing deformation of a plate.

Solution to Problem

In order to achieve the above-mentioned object, according to the present disclosure, there is provided a combustion device including: a plate facing a combustion chamber; a plurality of injection hole groups formed in the plate so as to have an annular shape; and a slit having an annular shape and formed between the plurality of injection hole groups.

The plurality of injection hole groups may include a first injection hole group and a second injection hole group. The first injection hole group includes: a plurality of fuel injection holes facing an interior of the combustion chamber and formed so as to be spaced apart from each other in a circumferential direction of the combustion chamber; a first air injection hole having an annular shape, facing the interior of the combustion chamber, and extending in the circumferential direction on a radially outer side with respect to the plurality of fuel injection holes; and a second air injection hole having an annular shape, facing the interior of the combustion chamber, and extending in the circumferential direction on a radially inner side with respect to the plurality of fuel injection holes. The second injection hole group faces the interior of the combustion chamber, and includes fuel injection holes, a first air injection hole, and a second air injection hole. The second injection hole group is located radially inward of the first injection hole group.

The combustion device may further include an annular cavity that is formed between the plurality of injection hole groups in the plate, and communicates with the slit.

The combustion device may further include a through-hole that is formed in the plate on a side opposite to the combustion chamber, and communicates with the annular cavity.

The through-hole may be displaced in a radial direction with respect to the slit.

In order to achieve the above-mentioned object, according to the present disclosure, there is provided a gas turbine system including the combustion device described above.

Effects

According to the present disclosure, deformation of the plate can be suppressed.

DESCRIPTION OF EMBODIMENTS

Figure 1:
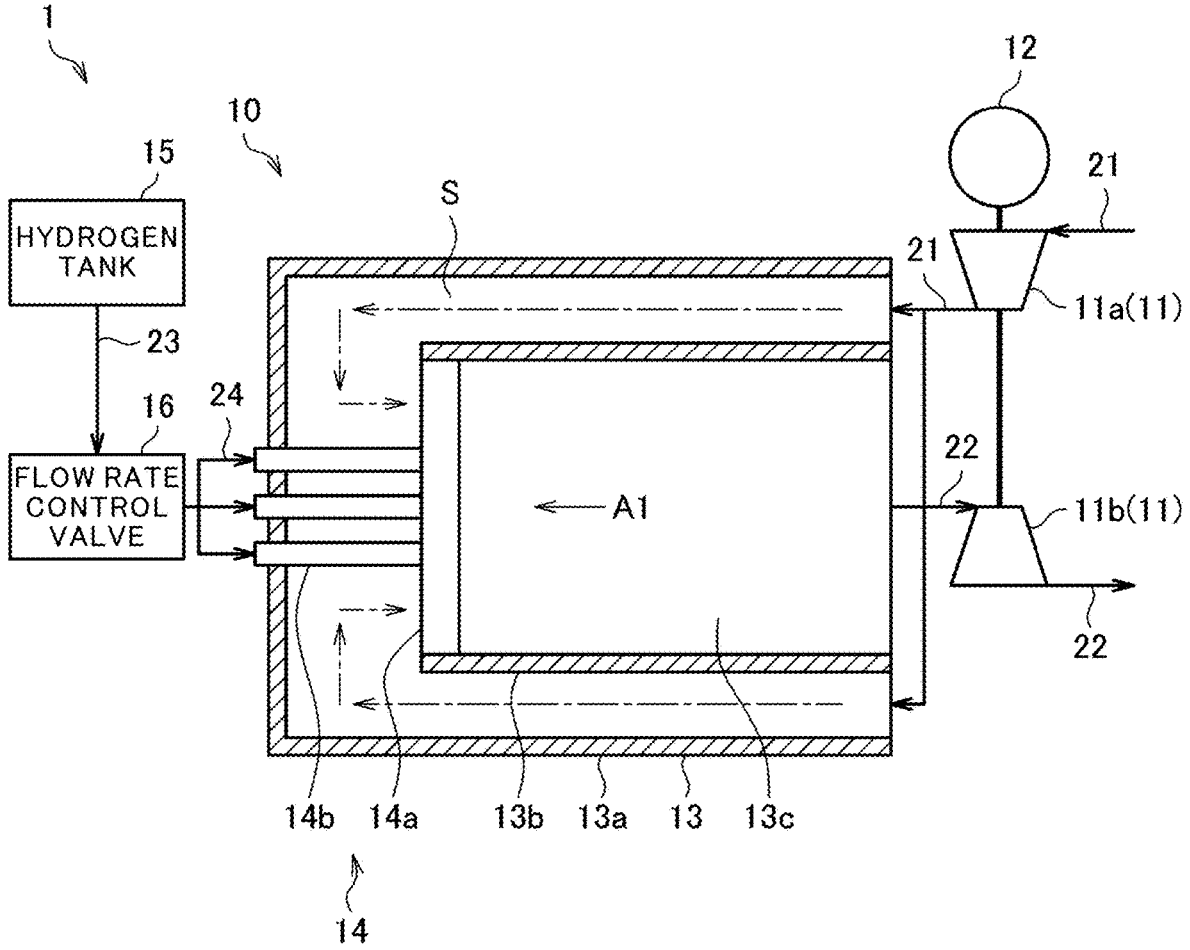
FIG. 1 is a schematic view for illustrating a configuration of a gas turbine system according to an embodiment of the present disclosure.

Now, with reference to the attached drawings, an embodiment of the present disclosure is described. The dimensions, materials, and other specific numerical values represented in the embodiment are merely examples used for facilitating the understanding of the disclosure, and do not limit the present disclosure unless otherwise particularly noted. Elements having substantially the same functions and configurations herein and in the drawings are denoted by the same reference symbols to omit redundant descriptions thereof. Further, illustration of elements with no direct relationship to the present disclosure is omitted.

FIG. 1 is a schematic view for illustrating a configuration of a gas turbine system 1 according to an embodiment. As illustrated in FIG. 1, the gas turbine system 1 includes a turbocharger 11, a power generator 12, a combustor 13, a burner 14, a hydrogen tank 15, and a flow rate control valve 16.

Of the gas turbine system 1, the combustor 13, the burner 14, the hydrogen tank 15, and the flow rate control valve 16 are included in a combustion device 10.

The turbocharger 11 includes a compressor 11*a* and a turbine 11*b*. The compressor 11*a* and the turbine 11*b* rotate integrally. The compressor 11*a* and the turbine 11*b* are connected by a shaft.

The compressor 11*a* is provided in an intake flow passage 21 connected to the combustor 13. Air to be supplied to the combustor 13 flows through the intake flow passage 21. An intake port (not shown) is formed at an upstream-side end portion of the intake flow passage 21. The intake port allows air to be introduced from an outside. The air introduced through the intake port passes through the compressor 11*a* and is sent to the combustor 13. The compressor 11*a* compresses the air and discharges the compressed air to a downstream side.

The turbine 11*b* is provided in an exhaust flow passage 22 connected to the combustor 13. An exhaust gas discharged from the combustor 13 flows through the exhaust flow passage 22. An exhaust port (not shown) is formed at a downstream-side end portion of the exhaust flow passage 22. The exhaust port allows the exhaust gas to be discharged to the outside. The exhaust gas discharged from the combustor 13 passes through the turbine 11*b* and is sent to the exhaust port. The turbine 11*b* is rotated by the exhaust gas to generate rotational power.

The power generator 12 is connected to the turbocharger 11. The power generator 12 generates electric power with use of the rotational power generated by the turbocharger 11.

The combustor 13 includes a casing 13*a*, a liner 13*b*, and a combustion chamber 13*c*. The casing 13*a* has a substantially cylindrical shape. The liner 13*b* is provided inside the casing 13*a*. The liner 13*b* has a substantially cylindrical shape. The liner 13*b* is arranged coaxially with the casing 13*a*. The combustion chamber 13*c* is formed inside the liner 13*b*. That is, an interior space of the liner 13*b* corresponds to the combustion chamber 13*c*. The combustion chamber 13*c* is a space having a substantially cylindrical shape. The exhaust flow passage 22 is connected to the combustion chamber 13*c*.

As described later, hydrogen and air are supplied into the combustion chamber 13*c*. In the combustion chamber 13*c*, hydrogen is used as fuel to cause combustion. An exhaust gas generated as a result of combustion in the combustion chamber 13*c* is discharged to the exhaust flow passage 22. A space S is defined between an inner surface of the casing 13*a* and an outer surface of the liner 13*b*. The intake flow passage 21 is connected to the space S. Air is fed into the space S from the compressor 11*a* via the intake flow passage 21. An opening is formed in an end portion (left end portion in FIG. 1) of the liner 13*b*. The burner 14 is inserted through the opening in the end portion of the liner 13*b*.

The burner 14 includes a burner plate (plate) 14*a* and a plurality of fuel supply pipes 14*b*. The burner plate 14*a* faces the combustion chamber 13*c*. The burner plate 14*a* seals the opening in the end portion of the liner 13*b*. That is, the burner plate 14*a* seals an end portion of the combustion chamber 13*c*. The burner plate 14*a* has a disk shape. However, the shape of the burner plate 14*a* is not limited thereto, and the burner plate 14*a* may have a shape other than a disk shape. For example, the burner plate 14*a* may have a polygonal shape. Further, the burner plate 14*a* may be formed of a plurality of separate pieces obtained by dividing a circular or polygonal plate. The burner plate 14*a* is formed by metal lamination molding. The fuel supply pipes 14*b* are connected to a surface of the burner plate 14*a* on a side opposite to the combustion chamber 13*c*. In other words, the fuel supply pipes 14*b* are connected to the surface of the burner plate 14*a* facing the space S. The fuel supply pipes 14*b* extend through the casing 13*a* to an outside of the casing 13*a*. In FIG. 1, three fuel supply pipes 14*b* are illustrated. However, the number of the fuel supply pipes 14*b* is not limited.

As described later with reference to FIGS. 2 to 5, the burner plate 14*a* has fuel injection holes (specifically, fuel injection holes 31 to be described later) and air injection holes (specifically, first air injection holes 32 and second air injection holes 33 to be described later) formed therein. The fuel injection holes formed in the burner plate 14*a* communicate with the fuel supply pipes 14*b*. Hydrogen is fed as fuel into the fuel supply pipes 14*b* as described later. The hydrogen fed from the fuel supply pipes 14*b* to the burner plate 14*a* passes through the fuel injection holes of the burner plate 14*a*, and is injected into the combustion chamber 13*c*. As indicated by the single-dotted arrows in FIG. 1, the air fed into the space S passes through the space S, and then reaches the surface of the burner plate 14*a* on the side opposite to the combustion chamber 13*c*. The air fed to the burner plate 14*a* passes through the air injection holes of the burner plate 14*a*, and is injected into the combustion chamber 13*c*.

Hydrogen is stored in the hydrogen tank 15. In the hydrogen tank 15, the hydrogen may be liquid or gaseous. The hydrogen tank 15 is connected to the flow rate control valve 16 via a flow passage 23. The flow rate control valve 16 is connected to each fuel supply pipe 14*b* of the burner 14 via a flow passage 24. The hydrogen stored in the hydrogen tank 15 is supplied into the fuel supply pipes 14*b* via the flow passage 23, the flow rate control valve 16, and the flow passage 24. The flow rate control valve 16 controls (i.e., adjusts) a flow rate of the hydrogen to be supplied from the hydrogen tank 15 into the fuel supply pipes 14*b*. Through adjustment of an opening degree of the flow rate control valve 16, a supply amount of hydrogen from the hydrogen tank 15 into the fuel supply pipes 14*b* is adjusted.

In the following, a circumferential direction of the combustion chamber 13*c* is also referred to simply as "circumferential direction". A radial direction of the combustion chamber 13*c* is also referred to simply as "radial direction". An axial direction of the combustion chamber 13*c* is also referred to simply as "axial direction".

Figure 2:
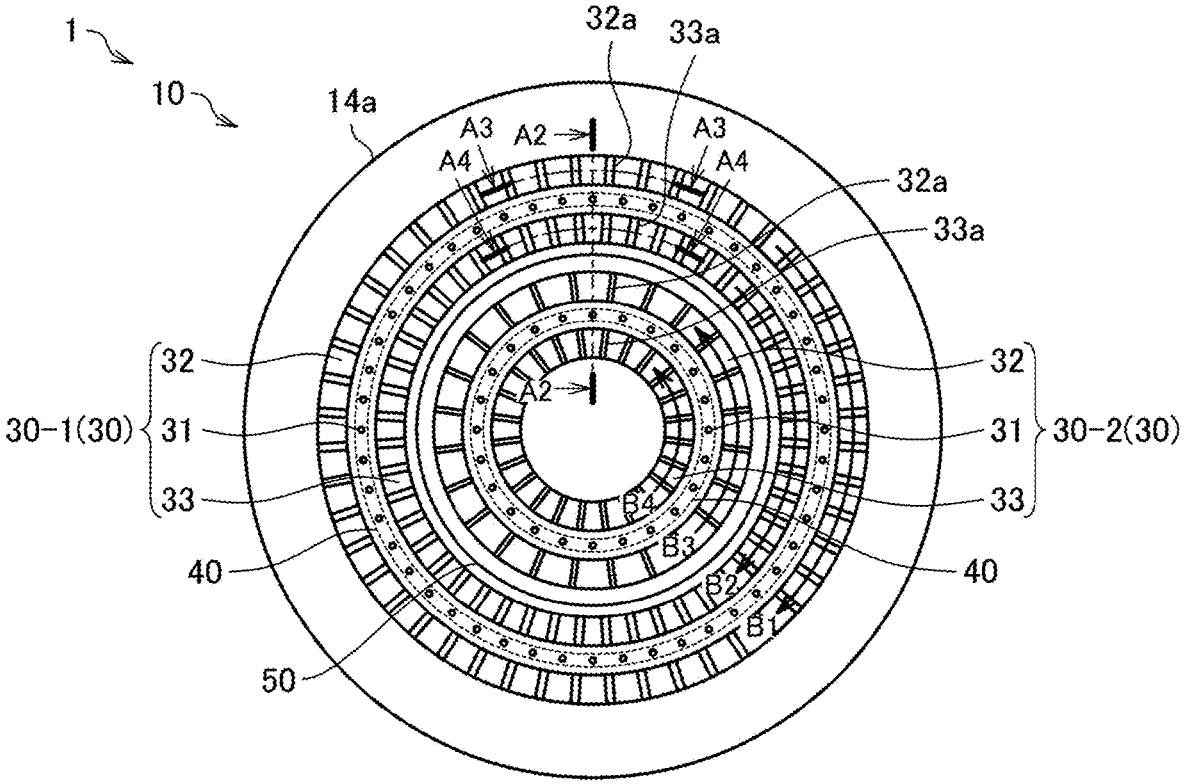
FIG. 2 is a view of a burner plate in the embodiment of the present disclosure as seen from a combustion chamber side.
Figure 3:
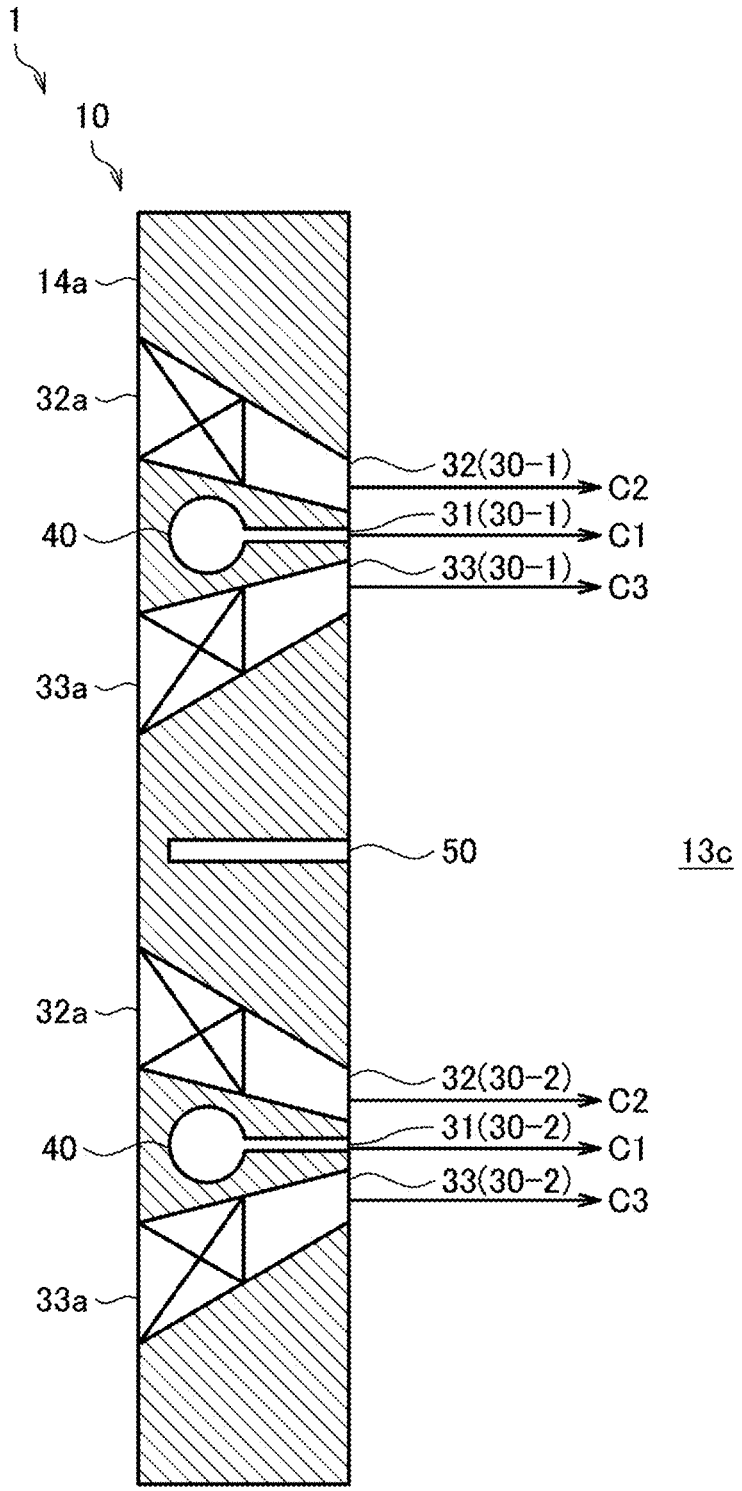
FIG. 3 is a cross-sectional view taken along the line A2-A2 of FIG. 2.
Figure 4:
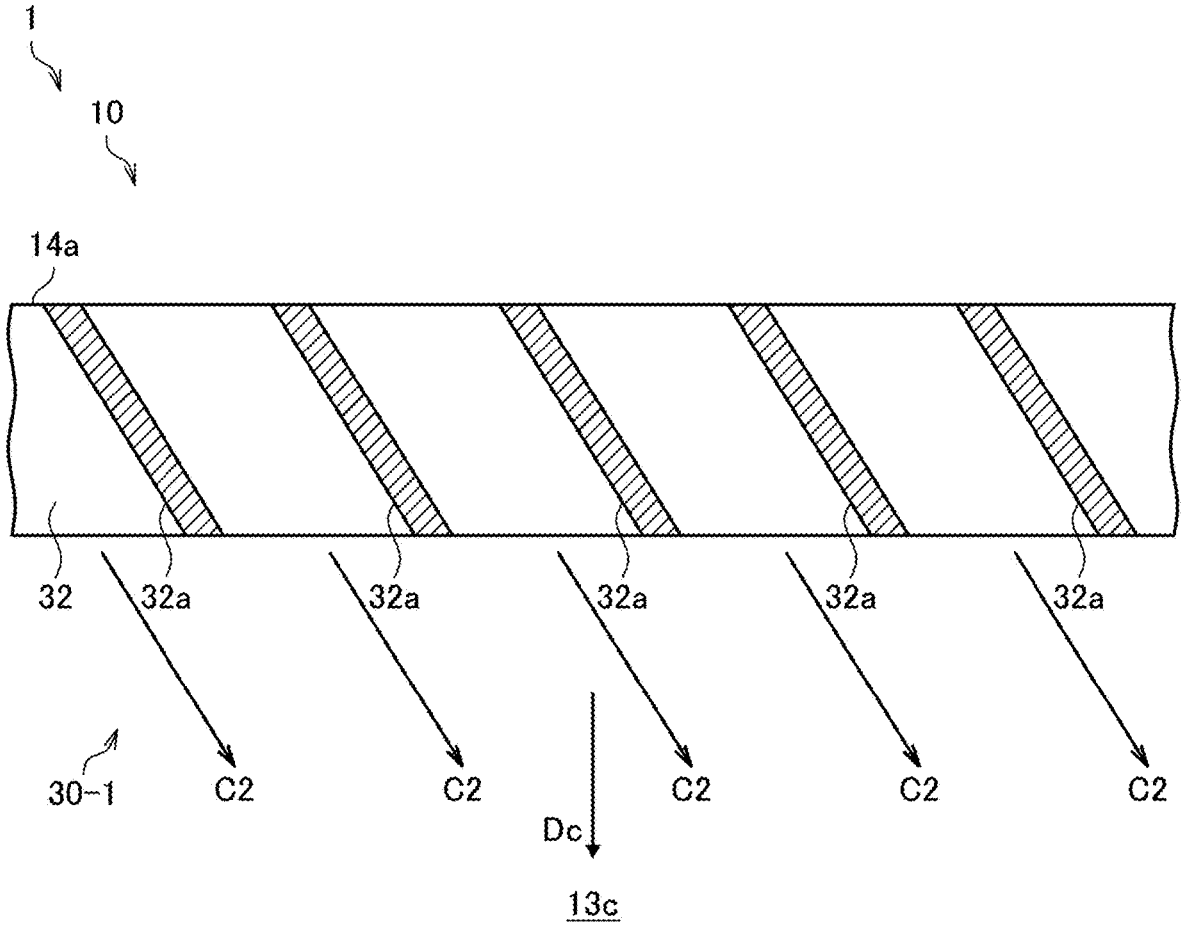
FIG. 4 is a cross-sectional view taken along the line A3-A3 of FIG. 2.
Figure 5:
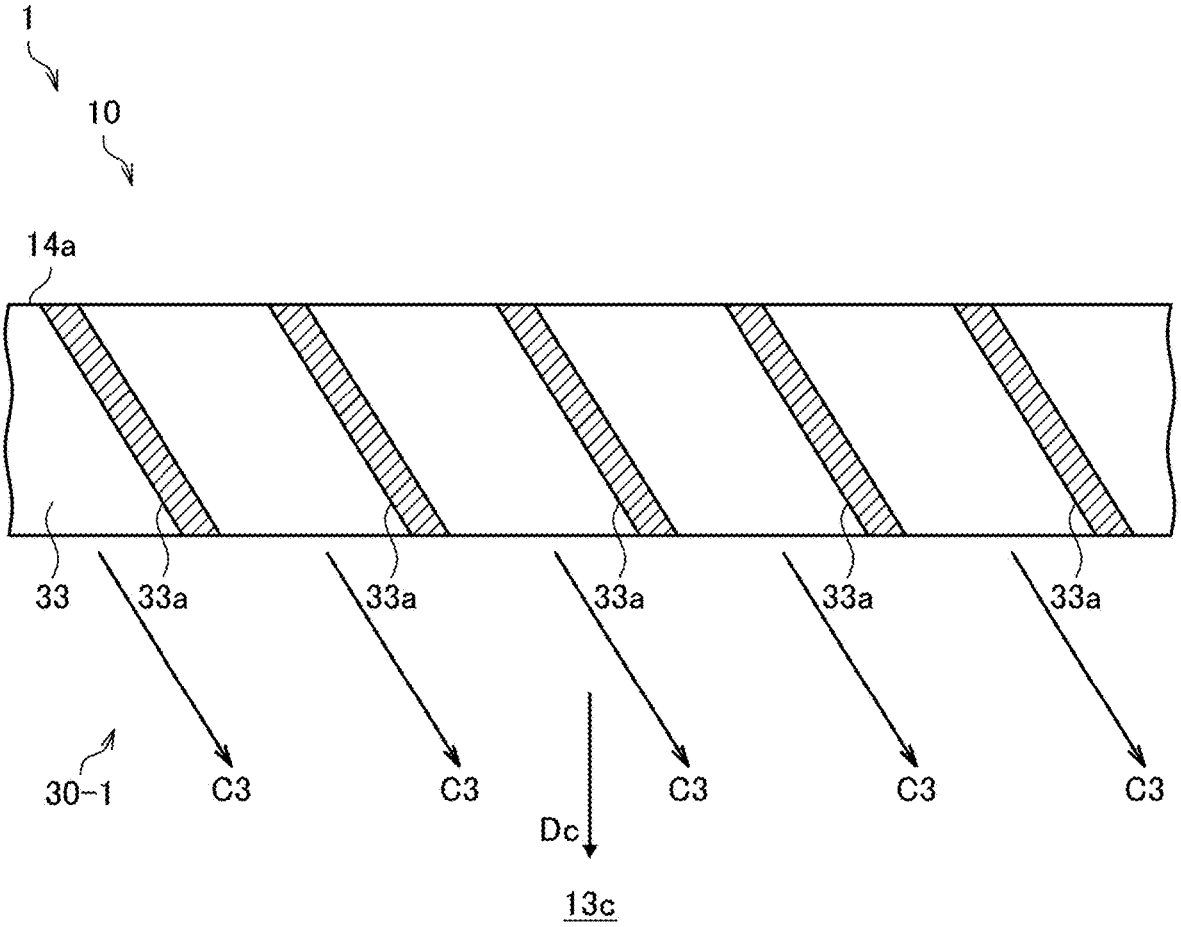
FIG. 5 is a cross-sectional view taken along the line A4-A4 of FIG. 2.

FIG. 2 is a view of the burner plate 14*a* as seen from the combustion chamber 13*c* (specifically, from a direction of the arrow A1 in FIG. 1). FIG. 3 is a cross-sectional view taken along the line A2-A2 of FIG. 2. FIG. 4 is a cross-sectional view taken along the line A3-A3 of FIG. 2. FIG. 5 is a cross-sectional view taken along the line A4-A4 of FIG. 2.

As illustrated in FIG. 2, a plurality of injection hole groups 30 (specifically, a first injection hole group 30-1 and a second injection hole group 30-2) are formed in the burner plate 14*a*. Each injection hole group 30 includes the plurality of fuel injection holes 31, the first air injection holes 32, and the second air injection holes 33. Each injection hole group 30 extends in the circumferential direction and has an annular shape. The first injection hole group 30-1 is arranged radially outward of the second injection hole group 30-2. In other words, the second injection hole group 30-2 is arranged radially inward of the first injection hole group 30-1. Thus, the first injection hole group 30-1 and the second injection hole group 30-2 are formed so as to be spaced apart from each other in the radial direction. However, the number of the injection hole groups 30 formed in the burner plate 14*a* is not limited to this example. For example, the number of the injection hole groups 30 formed in the burner plate 14*a* may be one, or three or more. A configuration of the first injection hole group 30-1 and a configuration of the second injection hole group 30-2 are similar. Accordingly, the configuration of the first injection hole group 30-1 is described in detail below, and a detailed description of the configuration of the second injection hole group 30-2 is omitted.

The fuel injection holes 31 face an interior of the combustion chamber 13*c*. The fuel injection holes 31 are open in the surface of the burner plate 14*a* facing the combustion chamber 13*c*. The fuel injection holes 31 are hydrogen injection holes from which hydrogen is injected as fuel into the combustion chamber 13*c*. In each injection hole group 30, the plurality of fuel injection holes 31 are formed so as to be spaced apart from each other in the circumferential direction. In each injection hole group 30, the plurality of fuel injection holes 31 are formed at equal intervals. However, in each injection hole group 30, the plurality of fuel injection holes 31 may be formed at unequal intervals.

In the burner plate 14*a*, a communication hole 40 is formed for each injection hole group 30. The communication hole 40 communicates with the plurality of fuel injection holes 31. The communication hole 40 extends in the circumferential direction. The communication hole 40 is formed into, for example, an annular shape. As illustrated in FIG. 2 and FIG. 3, the communication hole 40 is aligned in the axial direction with the plurality of fuel injection holes 31 of each injection hole group 30. The communication hole 40 is arranged on the side opposite to the combustion chamber 13*c* with respect to the plurality of fuel injection holes 31 of each injection hole group 30. In the example of FIG. 3, a transverse-sectional shape of the communication hole 40 (specifically, a shape in cross-section orthogonal to an extending direction of the communication hole 40) is circular. However, the transverse-sectional shape of the communication hole 40 may be a shape other than a circular shape (for example, a polygonal shape).

The fuel supply pipes 14*b* of the burner 14 are connected to the communication holes 40 of the injection hole groups 30. Hydrogen is supplied from the fuel supply pipes 14*b* to each of the communication holes 40. As indicated by the arrows C1 in FIG. 3, the hydrogen supplied to the communication holes 40 is injected into the combustion chamber 13*c* from each fuel injection hole 31. The hydrogen supplied to the communication hole 40 of the first injection hole group 30-1 is injected into the combustion chamber 13*c* from the plurality of fuel injection holes 31 of the first injection hole group 30-1. The hydrogen supplied to the communication hole 40 of the second injection hole group 30-2 is injected into the combustion chamber 13*c* from the plurality of fuel injection holes 31 of the second injection hole group 30-2.

The first air injection hole 32 faces the interior of the combustion chamber 13*c*. The first air injection hole 32 penetrates the burner plate 14*a* from the surface facing the combustion chamber 13*c* to the surface on the side opposite thereto. In each injection hole group 30, the first air injection hole 32 is formed on a radially outer side with respect to the plurality of fuel injection holes 31. The first air injection hole 32 extends in the circumferential direction and is formed into an annular shape. An outer diameter and an inner diameter of the first air injection hole 32 decrease from the side opposite to the combustion chamber 13*c* toward the combustion chamber 13*c*. A change amount in the inner diameter of the first air injection hole 32 is smaller than a change amount in the outer diameter of the first air injection hole 32. Accordingly, an opening area of the first air injection hole 32 on the side facing the combustion chamber 13*c* is smaller than an opening area thereof on the side opposite to the combustion chamber 13*c*. Further, a center axis direction of the first air injection hole 32 is inclined toward the fuel injection holes 31 with respect to the axial direction, that is, inward in the radial direction. As indicated by the arrows C2 in FIG. 3 and FIG. 4, part of the air fed through the space S in the combustor 13 to the burner plate 14*a* is injected from the first air injection holes 32 into the combustion chamber 13*c*.

First swirling blades 32*a* that are inclined in the circumferential direction with respect to a combustion-chamber-side axial direction Dc are provided in the first air injection hole 32. In the present disclosure, the combustion-chamber-side axial direction Dc may also be referred to simply as "direction Dc". The direction Dc is a direction directed to the combustion chamber 13*c* along the axial direction of the combustion chamber 13*c*. To incline in the circumferential direction with respect to the direction Dc means to extend in a direction of a vector obtained by combining a vector of the circumferential direction with a vector of the direction Dc, or to incline so as to advance in the circumferential direction as the first swirling blades 32*a* approach the combustion chamber 13*c*. Each first swirling blade 32*a* has, for example, a substantially flat plate shape. The first swirling blades 32*a* partition the first air injection hole 32 in the circumferential direction. Each first swirling blade 32*a* extends on a plane that intersects the circumferential direction. In each first air injection hole 32, the plurality of first swirling blades 32*a* are provided so as to be spaced apart from each other in the circumferential direction. In each first air injection hole 32, the plurality of first swirling blades 32*a* are provided at equal intervals. However, in each first air injection hole 32, the plurality of first swirling blades 32*a* may be provided at unequal intervals.

For example, as illustrated in FIG. 4, in the first air injection hole 32 of the first injection hole group 30-1, the first swirling blades 32*a* are inclined to one side in the circumferential direction (clockwise direction in FIG. 2) with respect to the direction Dc. Here, the direction of the air to be injected from the first air injection hole 32 is along the first swirling blades 32*a*. Thus, as indicated by the arrows C2 in FIG. 4, the direction of the air to be injected from the first air injection hole 32 of the first injection hole group 30-1 is inclined to the one side in the circumferential direction with respect to the direction Dc. Accordingly, as indicated by the arrow B1 in FIG. 2, the air injected from the first air injection hole 32 of the first injection hole group 30-1 swirls to the one side in the circumferential direction in the combustion chamber 13*c*.

The second air injection hole 33 faces the interior of the combustion chamber 13*c*. The second air injection hole 33 penetrates the burner plate 14*a* from the surface facing the combustion chamber 13*c* to the surface on the side opposite thereto. In each injection hole group 30, the second air injection hole 33 is formed on a radially inner side with respect to the plurality of fuel injection holes 31. The second air injection hole 33 extends in the circumferential direction and is formed into an annular shape. An outer diameter and an inner diameter of the second air injection hole 33 increase from the side opposite to the combustion chamber 13*c* toward the combustion chamber 13*c*. A change amount in the outer diameter of the second air injection hole 33 is smaller than a change amount in the inner diameter of the second air injection hole 33. Accordingly, an opening area of the second air injection hole 33 on the side facing the combustion chamber 13*c* is smaller than an opening area thereof on the side opposite to the combustion chamber 13*c*. Further, a center axis direction of the second air injection hole 33 is inclined toward the fuel injection holes 31 with respect to the axial direction, that is, outward in the radial direction. As indicated by the arrows C3 in FIG. 3 and FIG. 5, part of the air fed through the space S in the combustor 13 to the burner plate 14*a* is injected from the second air injection hole 33 into the combustion chamber 13*c*.

Second swirling blades 33*a* that are inclined to the same side in the circumferential direction with respect to the direction Dc as the first swirling blades 32*a* (specifically, the first swirling blades 32*a* belonging to the same injection hole group 30) are provided in the second air injection hole 33. Each second swirling blade 33*a* has, for example, a substantially flat plate shape. The second swirling blades 33*a* partition the second air injection hole 33 in the circumferential direction. Each second swirling blade 33*a* extends on a plane that intersects the circumferential direction. In each second air injection hole 33, the plurality of second swirling blades 33*a* are provided so as to be spaced apart from each other in the circumferential direction. In each second air injection hole 33, the plurality of second swirling blades 33*a* are provided at equal intervals. However, in each second air injection hole 33, the plurality of second swirling blades 33*a* may be provided at unequal intervals.

For example, as illustrated in FIG. 5, in the second air injection hole 33 of the first injection hole group 30-1, the second swirling blades 33*a* are inclined to the one side in the circumferential direction (clockwise direction in FIG. 2) with respect to the direction Dc. Here, the direction of the air to be injected from the second air injection hole 33 is along the second swirling blades 33*a*. Thus, as indicated by the arrows C3 in FIG. 5, the direction of the air to be injected from the second air injection hole 33 of the first injection hole group 30-1 is inclined to the one side in the circumferential direction with respect to the direction Dc. Accordingly, as indicated by the arrow B2 in FIG. 2, the air injected from the second air injection hole 33 of the first injection hole group 30-1 swirls to the one side in the circumferential direction in the combustion chamber 13*c*.

The direction of inclination of the first swirling blades 32*a* and the second swirling blades 33*a* in the first injection hole group 30-1 with respect to the direction Dc, and the direction of inclination of the first swirling blades 32*a* and the second swirling blades 33*a* in the second injection hole group 30-2 with respect to the direction Dc are toward sides different from each other in the circumferential direction. That is, in the first air injection hole 32 of the second injection hole group 30-2, the first swirling blades 32*a* are inclined to the other side in the circumferential direction (counterclockwise direction in FIG. 2) with respect to the direction Dc. Accordingly, as indicated by the arrow B3 in FIG. 2, the air injected from the first air injection hole 32 of the second injection hole group 30-2 swirls to the other side in the circumferential direction in the combustion chamber 13*c*. In the second air injection hole 33 of the second injection hole group 30-2, the second swirling blades 33*a* are inclined to the other side in the circumferential direction with respect to the direction Dc. Accordingly, as indicated by the arrow B4 in FIG. 2, the air injected from the second air injection hole 33 of the second injection hole group 30-2 swirls to the other side in the circumferential direction in the combustion chamber 13*c*.

The direction of inclination of the first swirling blades 32*a* and the second swirling blades 33*a* in the first injection hole group 30-1 with respect to the direction Dc, and the direction of inclination of the first swirling blades 32*a* and the second swirling blades 33*a* in the second injection hole group 30-2 with respect to the direction Dc may be toward the same side in the circumferential direction. Hereinafter, a case in which the direction of inclination of the first swirling blades 32*a* and the second swirling blades 33*a* in the first injection hole group 30-1 with respect to the direction Dc, and the direction of inclination of the first swirling blades 32*a* and the second swirling blades 33*a* in the second injection hole group 30-2 with respect to the direction Dc are toward the same side in the circumferential direction is referred to as "inclination pattern 1". For example, the first swirling blades 32*a* and the second swirling blades 33*a* in the first injection hole group 30-1 are inclined to the one side in the circumferential direction (clockwise direction in FIG. 2) with respect to the direction Dc. At this time, the first swirling blades 32*a* and the second swirling blades 33*a* in the second injection hole group 30-2 are inclined to the one side in the circumferential direction (clockwise direction in FIG. 2) with respect to the direction Dc. The first swirling blades 32*a* and the second swirling blades 33*a* in the first injection hole group 30-1 may be inclined to the other side in the circumferential direction (counterclockwise direction in FIG. 2) with respect to the direction Dc. At this time, the first swirling blades 32*a* and the second swirling blades 33*a* in the second injection hole group 30-2 may be inclined to the other side in the circumferential direction (counterclockwise direction in FIG. 2) with respect to the direction Dc. This enables a strong swirling flow of air to be formed in the entire combustion chamber 13*c*, thereby being capable of ensuring good flame stability.

The direction of inclination of the first swirling blades 32*a* and the second swirling blades 33*a* in the first injection hole group 30-1 with respect to the direction Dc in the present embodiment is opposite in the circumferential direction to the direction of inclination of the first swirling blades 32*a* and the second swirling blades 33*a* in the second injection hole group 30-2 with respect to direction Dc. A case in which the direction of inclination of the first swirling blades 32*a* and the second swirling blades 33*a* in the first injection hole group 30-1, and the direction of inclination of the first swirling blades 32*a* and the second swirling blades 33*a* in the second injection hole group 30-2 are inclined in directions opposite to each other as described above is referred to as "inclination pattern 2". For example, the first swirling blades 32*a* and the second swirling blades 33*a* in the first injection hole group 30-1 are inclined to the one side in the circumferential direction (clockwise direction in FIG. 2) with respect to the direction Dc. At this time, the first swirling blades 32*a* and the second swirling blades 33*a* in the second injection hole group 30-2 are inclined to the other side in the circumferential direction (counterclockwise direction in FIG. 2) with respect to the direction Dc. With this configuration, the swirling flow of air is weakened due to reverse swirling between the injection hole groups 30, and thus the swirling flow of air in the entire combustion chamber 13*c* is weakened, which can suppress a melt loss of the burner 14.

As described above, in each injection hole group 30, in the first air injection hole 32 formed on the radially outer side with respect to the plurality of fuel injection holes 31, the first swirling blades 32*a* are provided to be inclined in the circumferential direction with respect to the direction Dc. In the second air injection hole 33 formed on the radially inner side with respect to the plurality of fuel injection holes 31, the second swirling blades 33*a* are provided to be inclined in the same direction as the first swirling blades 32*a* in the circumferential direction with respect to the direction Dc. Thus, the air injected from the first air injection hole 32 and the second air injection hole 33 swirls toward the same side in the circumferential direction in the combustion chamber 13*c*. Hydrogen is injected from the fuel injection holes 31 toward the swirling flow of air thus generated. Accordingly, the hydrogen injected from the fuel injection holes 31 is mixed with the air while being swirled by the swirling flow of air.

As described above, according to the combustion device 10 of the gas turbine system 1, hydrogen injected from the fuel injection holes 31 is rapidly mixed with the air by the swirling flow of air generated by the air injected from the first air injection hole 32 and the second air injection hole 33 in each injection hole group 30. Thus, as compared to a case in which hydrogen and air are supplied into the combustion chamber 13*c* in a pre-mixed state, an ignition position is likely to be at a more inner side in the combustion chamber 13*c*. Accordingly, backfires are suppressed. In addition, the melt loss of the burner 14 is suppressed. Accordingly, the burner 14 can be protected from flame. In addition, by adjusting an air supply amount as appropriate and lowering a flame temperature, a reduction in NOx emission amount can be achieved.

In each injection hole group 30, inclination angles of the first swirling blades 32*a* and the second swirling blades 33*a* (i.e., inclination angles with respect to the direction Dc) may be the same or different from each other.

Figure 6:
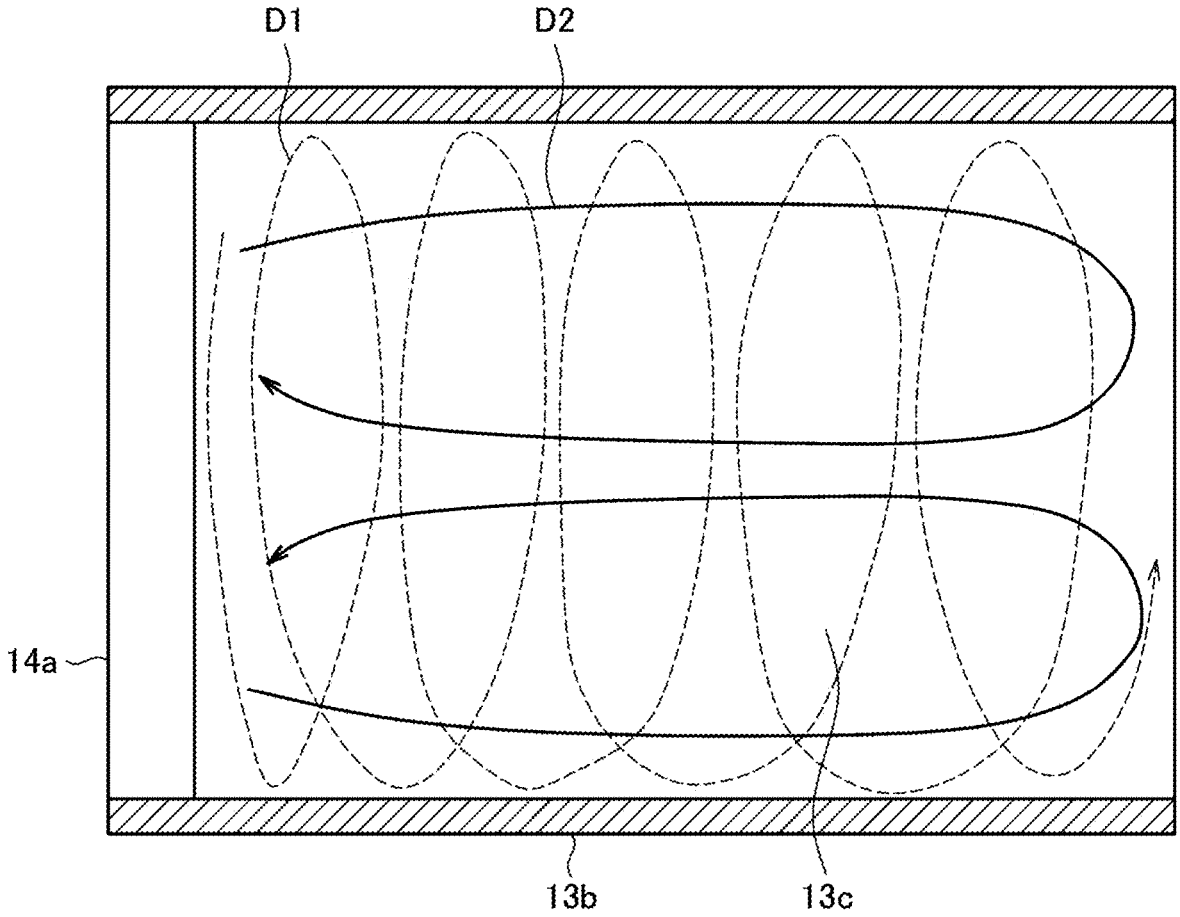
FIG. 6 is a schematic view for illustrating a flow of gas generated in the combustion chamber in the embodiment of the present disclosure.

FIG. 6 is a schematic view for illustrating a flow of gas generated in the combustion chamber 13*c*. In FIG. 6, the swirling flow of air generated by the air injected from the first air injection holes 32 and the second air injection holes 33 is indicated by the arrow D1. When the swirling flow of air is generated, there is generated a circulation flow, as indicated by the arrows D2, which is a flow of gas passing near a center axis of the swirling flow (i.e., near a center axis of the combustion chamber 13*c*) toward the burner plate 14*a*.

Here, in the combustion device 10, as described above, the direction of inclination of the first swirling blades 32*a* and the second swirling blades 33*a* in the first injection hole group 30-1 with respect to the direction Dc, and the direction of inclination of the first swirling blades 32*a* and the second swirling blades 33*a* in the second injection hole group 30-2 with respect to the direction Dc are toward the sides different from each other in the circumferential direction. Thus, a direction (specifically, clockwise direction in FIG. 2) of the swirling flow generated by the air injected from the first injection hole group 30-1, and a direction (specifically, counterclockwise direction in FIG. 2) of the swirling flow generated by the air injected from the second injection hole group 30-2 are opposite to each other. Accordingly, the swirling flow generated by the air injected from the first injection hole group 30-1, and the swirling flow generated by the air injected from the second injection hole group 30-2 weaken each other. Thus, the circulation flow (i.e., flow indicated by the arrows D2 in FIG. 6) passing near the center axis of the swirling flow toward the burner plate 14*a* is weakened. As a result, approach of flame to the burner plate 14*a* is suppressed. Accordingly, the melt loss of the burner 14 is suppressed.

In the axial direction, at a position where the swirling flow of air generated by the first injection hole group 30-1 and the swirling flow of air generated by the second injection hole group 30-2 interfere with each other, a local vortex is generated, and the gas injected from the first injection hole group 30-1 and the gas injected from the second injection hole group 30-2 are easily mixed with each other. As a result, the NOx emission amount is further reduced.

In the above-mentioned example of the inclination pattern 2, the first swirling blades 32*a* and the second swirling blades 33*a* of the first injection hole group 30-1 are inclined to the one side in the circumferential direction (clockwise direction in FIG. 2) with respect to the direction Dc. However, the first swirling blades 32*a* and the second swirling blades 33*a* of the first injection hole group 30-1 may be inclined to the other side in the circumferential direction (counterclockwise direction in FIG. 2) with respect to the direction Dc. In this case, the first swirling blades 32*a* and the second swirling blades 33*a* of the second injection hole group 30-2 are inclined to the one side in the circumferential direction with respect to the direction Dc.

The direction of inclination of the first swirling blades 32*a* in the first injection hole group 30-1 with respect to the direction Dc may be toward the same side in the circumferential direction as the direction of inclination of the first swirling blades 32*a* in the second injection hole group 30-2 with respect to the direction Dc. At this time, the direction of inclination of the second swirling blades 33*a* in the first injection hole group 30-1 with respect to the direction Dc may be toward the same side in the circumferential direction as the direction of inclination of the second swirling blades 33*a* in the second injection hole group 30-2 with respect to the direction Dc. The direction of inclination of the first swirling blades 32*a* in the first injection hole group 30-1 and the second injection hole group 30-2 with respect to the direction Dc may be opposite to the direction of inclination of the second swirling blades 33*a* in the first injection hole group 30-1 and the second injection hole group 30-2 with respect to the direction Dc. A case in which the first swirling blades 32*a* in the first injection hole group 30-1 and the second injection hole group 30-2 and the second swirling blades 33*a* in the first injection hole group 30-1 and the second injection hole group 30-2 are thus inclined in directions opposite to each other is referred to as "inclination pattern 3". For example, the first swirling blades 32*a* of the first injection hole group 30-1 may be inclined to the one side in the circumferential direction (clockwise direction in FIG. 2) with respect to the direction Dc, and the second swirling blades 33*a* of the first injection hole group 30-1 may be inclined to the other side in the circumferential direction (counterclockwise in FIG. 2) with respect to the direction Dc. At this time, the first swirling blades 32*a* of the second injection hole group 30-2 may be inclined to the one side in the circumferential direction (clockwise direction in FIG. 2) with respect to the direction Dc, and the second swirling blades 33*a* of the second injection hole group 30-2 may be inclined to the other side in the circumferential direction (counterclockwise direction in FIG. 2) with respect to the direction Dc. This weakens the swirling flow of air within and outside each injection hole group 30 and between the injection hole groups 30 due to reverse swirling. Thus, the swirling flow of air is weakened in the entire combustion chamber 13*c* more than in the inclination pattern 2, thereby being capable of suppressing the melt loss of the burner 14. In addition, the reverse swirling within and outside each injection hole group 30 enables rapid mixing of hydrogen injected from the fuel injection holes 31 and air.

Further, the direction of inclination of the first swirling blades 32*a* in the first injection hole group 30-1 with respect to the direction Dc may be toward the side in the circumferential direction, which is opposite to the direction of inclination of the first swirling blades 32*a* in the second injection hole group 30-2 with respect to the direction Dc. At this time, the direction of inclination of the second swirling blades 33*a* in the first injection hole group 30-1 with respect to the direction Dc may be toward the side in the circumferential direction, which is opposite to the direction of inclination of the second swirling blades 33*a* in the second injection hole group 30-2 with respect to the direction Dc. The direction of inclination of the first swirling blades 32*a* in the first injection hole group 30-1 and the second swirling blades 33*a* in the second injection hole group 30-2 with respect to the direction Dc may be opposite to the direction of inclination of the second swirling blades 33*a* in the first injection hole group 30-1 and the first swirling blades 32*a* in the second injection hole group 30-2 with respect to the direction Dc. A case in which the first swirling blades 32*a* in the first injection hole group 30-1 and the second swirling blades 33*a* in the second injection hole group 30-2, and the second swirling blades 33*a* in the first injection hole group 30-1 and the first swirling blades 32*a* in the second injection hole group 30-2 are thus inclined in directions opposite to each other is referred to as "inclination pattern 4". For example, the first swirling blades 32*a* of the first injection hole group 30-1 may be inclined to the one side in the circumferential direction (clockwise direction in FIG. 2) with respect to the direction Dc, and the second swirling blades 33*a* of the first injection hole group 30-1 may be inclined to the other side in the circumferential direction (counterclockwise in FIG. 2) with respect to the direction Dc. At this time, the first swirling blades 32*a* of the second injection hole group 30-2 may be inclined to the other side in the circumferential direction (counterclockwise direction in FIG. 2) with respect to the direction Dc, and the second swirling blades 33*a* of the second injection hole group 30-2 may be inclined to the one side in the circumferential direction (clockwise direction in FIG. 2) with respect to the direction Dc. This strengthens the swirling flow of air due to forward swirling between the injection hole groups 30, and weakens the swirling flow of air due to reverse swirling within and outside each injection hole group 30. As a result, the swirling flow of air can be weakened more than in the inclination pattern 1 to be able to further suppress the melt loss of the burner 14, and the swirling flow of air can be strengthened more than in the inclination pattern 3 to be able to further improve the flame stability. In addition, hydrogen injected from the fuel injection holes 31 and air can be mixed rapidly due to the reverse swirling within and outside each injection hole group 30. When three or more injection hole groups 30 are provided, the above-mentioned inclination patterns 1 to 4 may be used in combination in the three or more injection hole groups 30.

In the combustion device 10, the injection hole groups 30 are formed in the burner plate 14*a* that seals the end portion of the combustion chamber 13*c*. Thus, through integral forming of the burner plate 14*a* by, for example, additive manufacturing technology, the injection hole groups 30 can be easily formed. When the burner plate 14*a* is thus integrally formed, as compared to a case in which a component forming the injection hole groups 30 is provided separately from the burner plate 14*a*, the structure of the burner 14 is simplified, the burner 14 is downsized, and manufacturing cost of the burner 14 is reduced. Further, leakage of hydrogen from joint portions of components is suppressed. In addition, occurrence of cracks in the joint portions due to thermal stress is suppressed.

In the combustion device 10, the communication hole 40 is formed in the burner plate 14*a*, and communicates with the plurality of fuel injection holes 31. Thus, through integral forming of the burner plate 14*a* by, for example, additive manufacturing technology, the communication hole 40 can be easily formed. When the burner plate 14*a* is thus integrally formed, as compared to a case in which a component forming the communication hole 40 is provided separately from the burner plate 14*a*, the structure of the burner 14 is simplified, the burner 14 is downsized, and the manufacturing cost of the burner 14 is reduced. Further, leakage of hydrogen from joint portions of components is suppressed. In addition, occurrence of cracks in the joint portions due to thermal stress is suppressed.

When the burner plate 14*a* is manufactured using the additive manufacturing technology, a metal lamination amount on the surface of the burner plate 14*a* facing the combustion chamber 13*c* is larger than a metal lamination amount on the surface opposite to the combustion chamber 13*c*. This is because the opening areas of the first air injection hole 32 and the second air injection hole 33 in the surface facing the combustion chamber 13*c* are smaller than the opening areas in the surface opposite to the combustion chamber 13*c*. As a temperature of metal laminated during the manufacture of the burner plate 14*a* decreases, the metal shrinks. At this time, a shrinkage force on a side with a larger metal lamination amount may cause the burner plate 14*a* to deform to the combustion chamber side with the larger metal lamination amount.

Accordingly, in the present embodiment, when the burner plate 14*a* is manufactured by the additive manufacturing technology, an annular slit 50 (see FIG. 2 and FIG. 3) is formed between the plurality of injection hole groups 30 of the burner plate 14*a*. The slit 50 is formed in the surface of the burner plate 14*a* facing the combustion chamber 13*c*. The slit 50 communicates with the combustion chamber 13*c*. That is, the slit 50 is open toward the combustion chamber 13*c*. The slit 50 extends in the axial direction of the combustion chamber 13*c*. However, the slit 50 may extend obliquely to the axial direction of the combustion chamber 13*c*.

A depth of the slit 50 is set so as to maintain a minimum thickness required to maintain strength of the burner plate 14*a* when the burner plate 14*a* is mounted to the liner 13*b*. The depth of the slit 50 is, for example, equal to or larger than a half of the thickness of the burner plate 14*a*. The depth of the slit 50 is, for example, equal to or larger than ⅘ of the thickness of the burner plate 14*a*.

A radial position of the slit 50 is determined so that, for example, a mass of the burner plate 14*a* on a radially outer side with respect to the slit 50 is balanced with a mass of the burner plate 14*a* on a radially inner side with respect to the slit 50. Thus, the radial position of the slit 50 is set at a position where a radius of the slit 50 is larger than half a radius of the burner plate 14*a*. However, the radial position of the slit 50 may be set at a position where the radius is half the radius of the burner plate 14*a* or a position where the radius is smaller than half the radius of the burner plate 14*a*.

According to the present embodiment, the burner plate 14*a* has the slit 50, and thus the first injection hole group 30-1 and the second injection hole group 30-2 are divided by the slit 50 in the surface of the burner plate 14*a* facing the combustion chamber 13*c*. Therefore, the shrinkage force of the metal, which is generated as the temperature of the laminated metal decreases during the manufacture of the burner plate 14*a*, is divided between the radially inner side and the radially outer side of the slit 50. As a result, deformation of the burner plate 14*a* can be suppressed as compared to a case in which the slit 50 is not formed.

Figure 7:
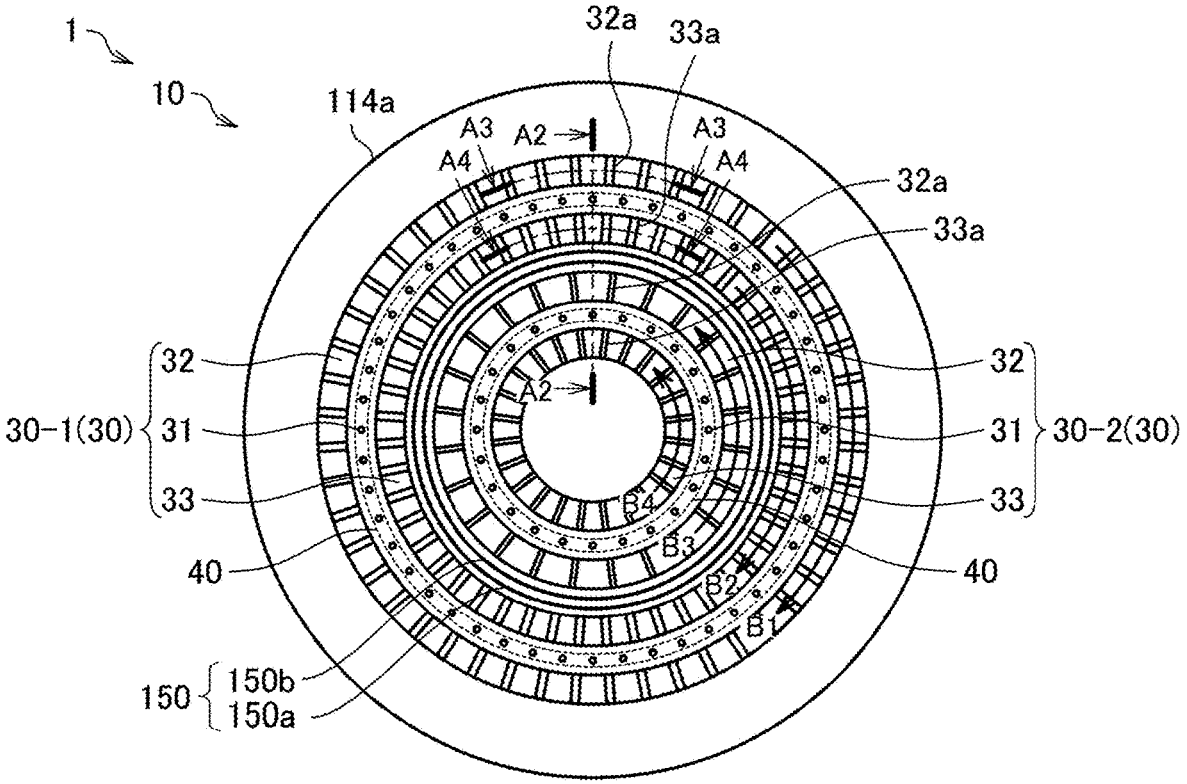
FIG. 7 is a schematic cross-sectional view for illustrating a configuration of a burner plate in a first modification example.

FIG. 7 is a schematic cross-sectional view for illustrating a configuration of a burner plate 114*a* in a first modification example. Components substantially equivalent to those of the burner plate 14*a* in the above-mentioned embodiment are denoted by the same reference symbols, and descriptions thereof are omitted. As illustrated in FIG. 7, the burner plate 114*a* in the first modification example differs from the burner plate of the above-mentioned embodiment in that a plurality of slits 150 are formed.

In the first modification example, the plurality of annular slits 150 are formed between the plurality of injection hole groups 30 of the burner plate 114*a*. The slits 150 are formed in the surface of the burner plate 114*a* facing the combustion chamber 13*c*. The slits 150 extend in the axial direction.

The plurality of slits 150 include a first slit 150*a* and a second slit 150*b*. However, the present disclosure is not limited thereto, and the plurality of slits 150 may include three or more slits. The first slit 150*a* and the second slit 150*b* are formed so as to be spaced apart from each other in the radial direction. The first slit 150*a* is located radially outward of the second slit 150*b*. In other words, the second slit 150*b* is located radially inward of the first slit 150*a*.

Depths of the first slit 150*a* and the second slit 150*b* are the same as those as given in the above-mentioned embodiment. However, the present disclosure is not limited thereto, and the depths of the first slit 150*a* and the second slit 150*b* may be different from those as given in the above-mentioned embodiment. Further, the depths of the first slit 150*a* and the second slit 150*b* may be different from each other.

Radial positions of the first slit 150*a* and the second slit 150*b* are determined so that, for example, a mass of the burner plate 114*a* on a radially outer side of the first slit 150*a* is balanced with a mass of the burner plate 114*a* on a radially inner side of the second slit 150*b*. Thus, the radial position of the first slit 150*a* is set at a position where a radius of the first slit 150*a* is larger than half a radius of the burner plate 114*a*. Further, the radial position of the second slit 150*b* is set at a position where a radius of the second slit 150*b* is smaller than half the radius of the burner plate 114*a*.

According to the first modification example, owing to forming of the plurality of slits 150, deformation of the burner plate 114*a* can be further suppressed as compared to the above-mentioned embodiment.

Figure 8:
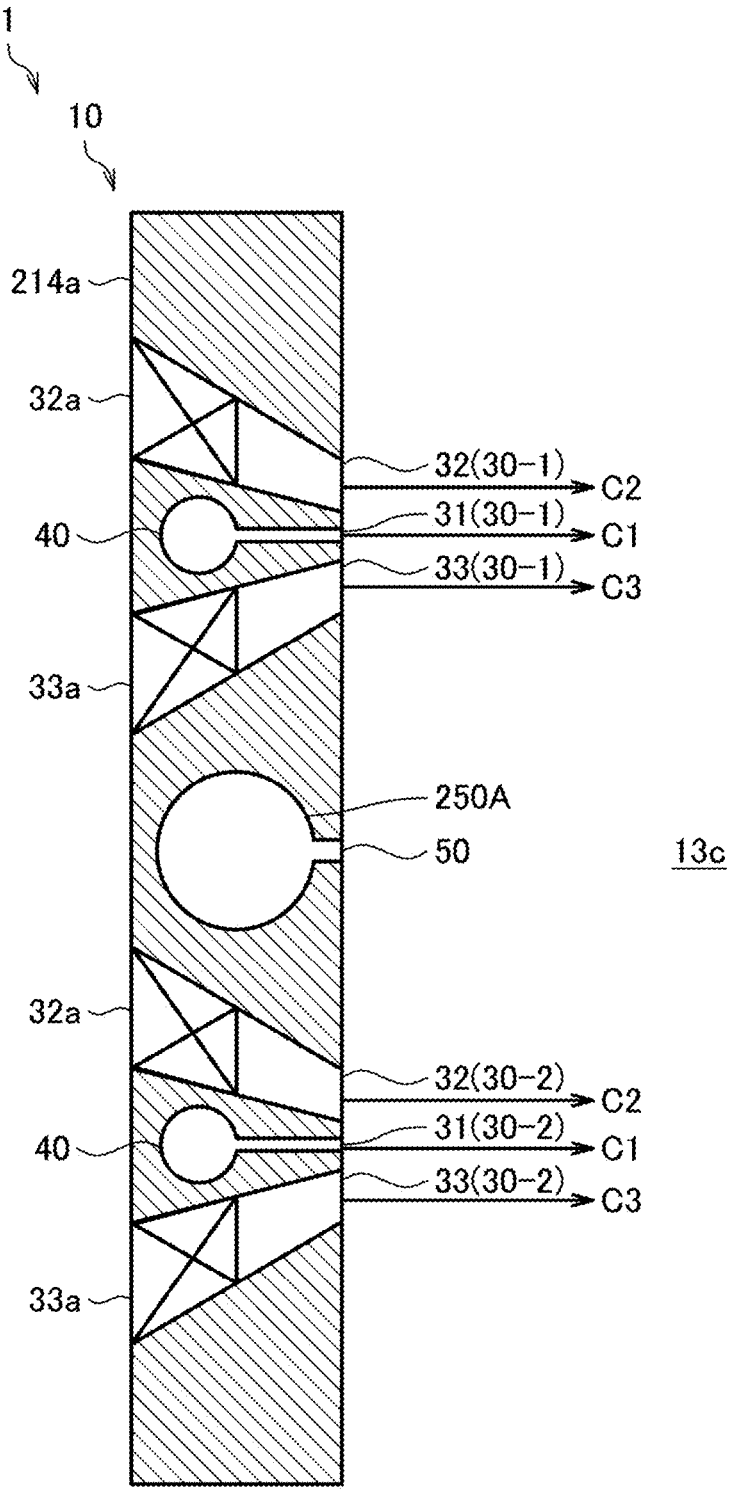
FIG. 8 is a schematic cross-sectional view for illustrating a configuration of a burner plate in a second modification example.

FIG. 8 is a schematic cross-sectional view for illustrating a configuration of a burner plate 214*a* in a second modification example. Components substantially equivalent to those of the burner plate 14*a* in the above-mentioned embodiment are denoted by the same reference symbols, and descriptions thereof are omitted. As illustrated in FIG. 8, the burner plate 214*a* in the second modification example differs from the burner plate of the above-mentioned embodiment in that an annular cavity 250A is formed.

As illustrated in FIG. 8, the annular cavity 250A is formed between the plurality of injection hole groups 30 of the burner plate 214*a*. The cavity 250A is separated from the injection hole groups 30 in the radial direction. The cavity 250A is formed in a substantially central position of the burner plate 214*a* in a thickness direction thereof. The cavity 250A communicates with the slit 50. The cavity 250A has a circular transverse-sectional shape (shape in a cross-section including a center axis of the burner plate 214*a*).

Figure 9:
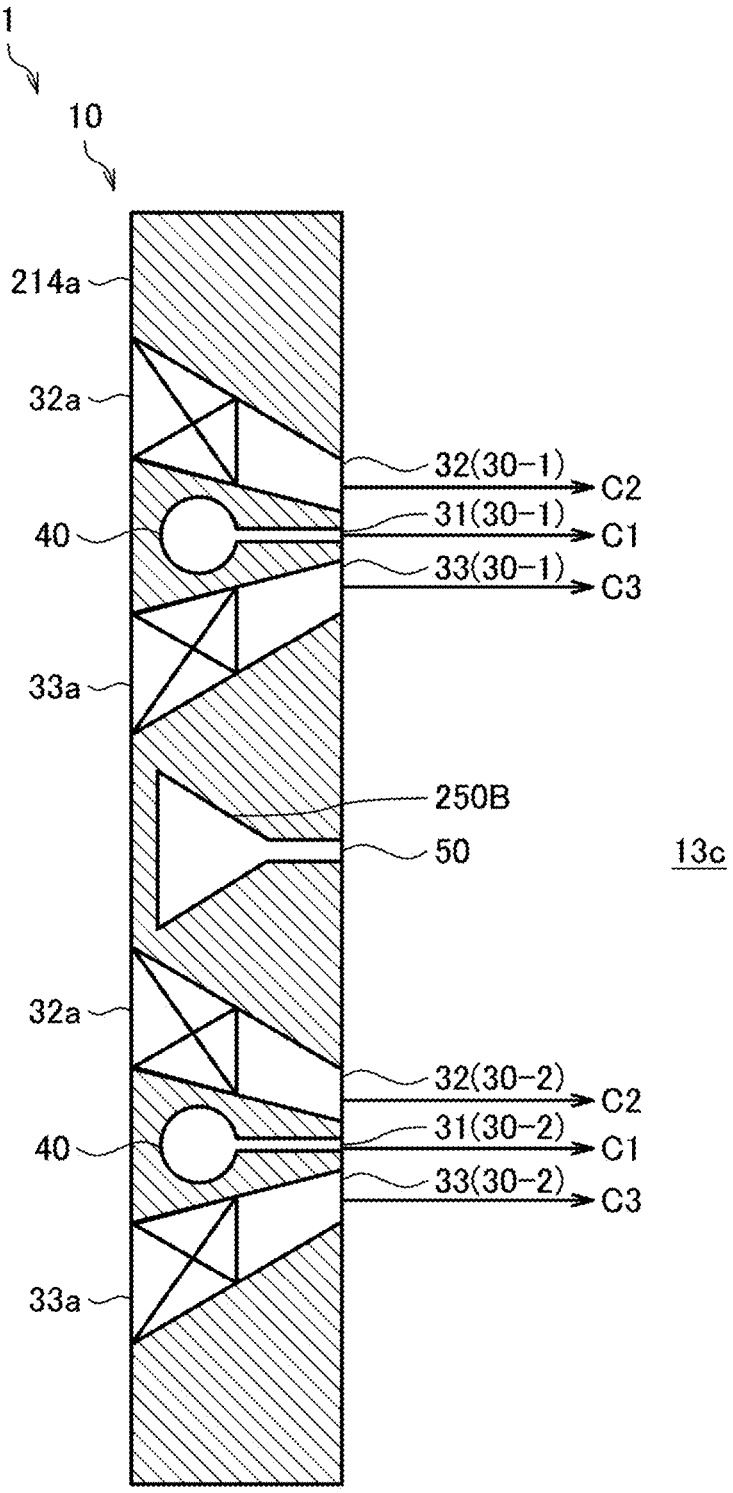
FIG. 9 is a schematic cross-sectional view for illustrating a first shape example of a cavity that is different from a cavity in the second modification example.
Figure 10:
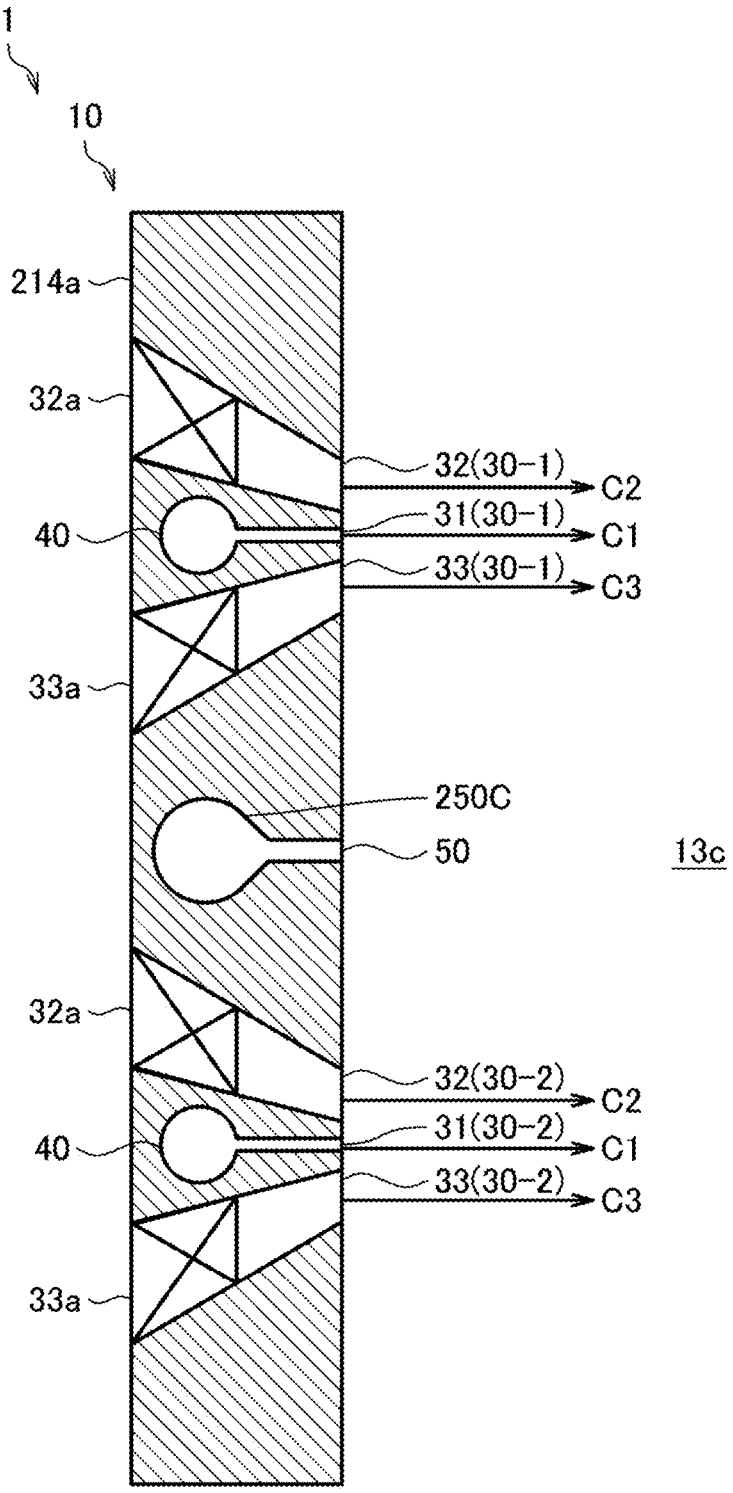
FIG. 10 is a schematic cross-sectional view for illustrating a second shape example of a cavity that is different from the cavity in the second modification example.

FIG. 9 is a schematic cross-sectional view for illustrating a first shape example of a cavity 250B that is different from the cavity 250A in the second modification example. FIG. 10 is a schematic cross-sectional view for illustrating a second shape example of a cavity 250C that is different from the cavity 250A in the second modification example. As illustrated in FIG. 9, the cavity 250B has a triangular transverse-sectional shape. As illustrated in FIG. 10, the cavity 250C has a water-drop-like transverse-sectional shape. The transverse-sectional shapes of the cavities 250A, 250B, and 250C are not limited to the shapes as illustrated in FIG. 8 to FIG. 10, but may be, for example, a semi-circular shape, an elliptical shape, or an ellipsoidal shape.

The cavities 250A, 250B, and 250C each have a curved surface on the side closer to the combustion chamber 13C, or a surface inclined from a plane perpendicular to the axial direction. In other words, the cavities 250A, 250B, and 250C each have no surface perpendicular to the axial direction on the side closer to the combustion chamber 13*c*. When the cavities 250A, 250B, and 250C each have a surface perpendicular to the axial direction on the side closer to the combustion chamber 13*c*, the burner plate 214*a* cannot be formed because portions corresponding to the cavities 250A, 250B, and 250C collapse during lamination using the additive manufacturing technology. Accordingly, in the second modification example, the cavities 250A, 250B, and 250C each have no surface perpendicular to the axial direction on the side closer to the combustion chamber 13*c*.

According to the second modification example, owing to forming of the cavities 250A, 250B, and 250C, a mass inside the burner plate 214*a* can be reduced. In other words, a metal deposition amount in the burner plate 214*a* can be reduced, and hence a weight of the burner plate 214*a* can be reduced. Accordingly, a degree of shrinkage that occurs when the metal is cooled during the manufacture of the burner plate 214*a* can be reduced. Further, the deposition amount is reduced, and hence a time period required to form the burner plate 214*a* can be reduced. In addition, cost of the burner plate 214*a* can be reduced. Further, owing to the reduction in weight of the burner plate 214*a*, work of mounting the burner plate 214*a* to the liner 13*b* is facilitated.

Figure 11:
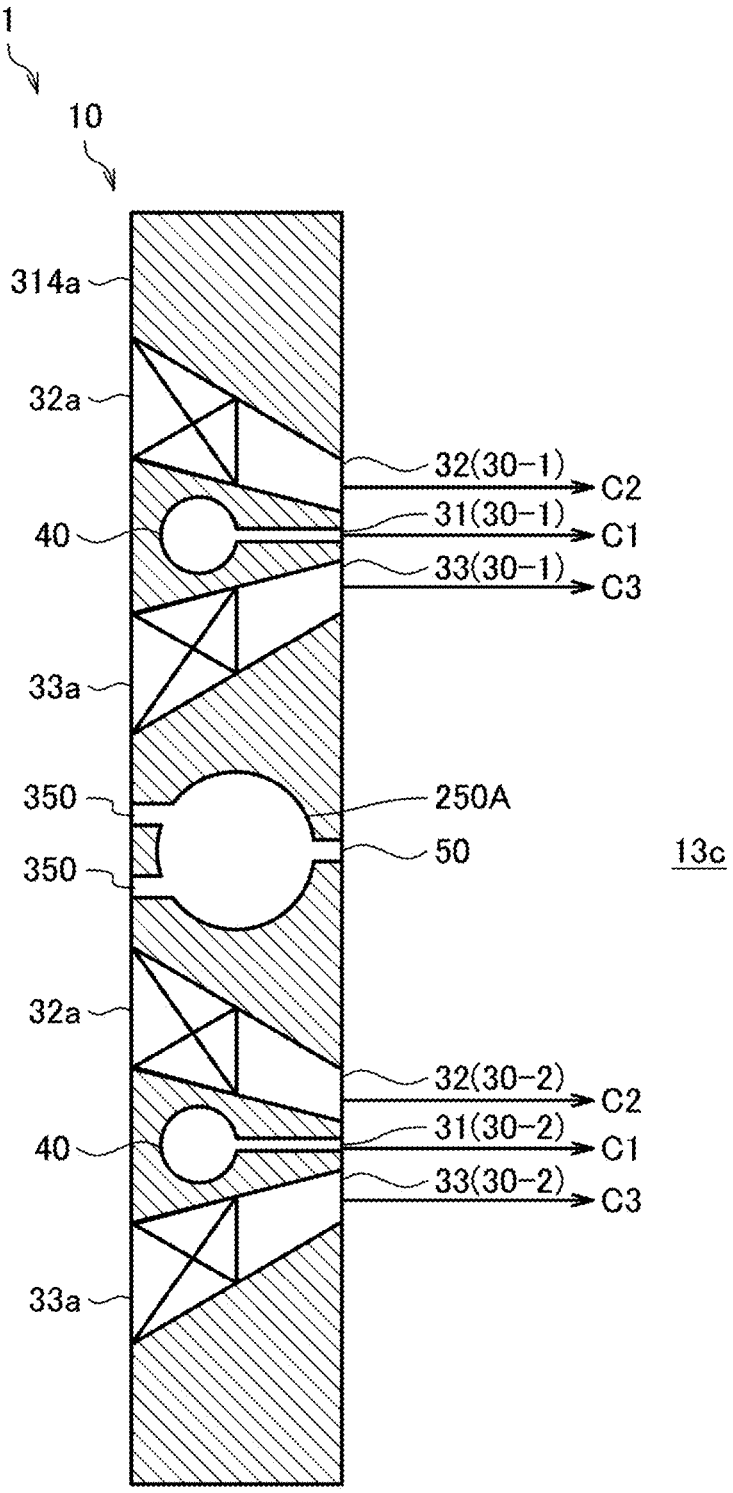
FIG. 11 is a schematic cross-sectional view for illustrating a configuration of a burner plate in a third modification example.

FIG. 11 is a schematic cross-sectional view for illustrating a configuration of a burner plate 314*a* in a third modification example. Components substantially equivalent to the configurations of the burner plate 214*a* in the above-mentioned second modification example are denoted by the same reference symbols, and descriptions thereof are omitted. As illustrated in FIG. 11, the burner plate 314*a* in the third modification example differs from the configuration of the above-mentioned second modification example in that through-holes 350 are formed.

In the third modification example, the through-holes 350 are formed between the plurality of injection hole groups 30 of the burner plate 314*a*. The through-holes 350 are formed on a side opposite to the combustion chamber 13*c* with respect to the cavity 250A. The through-holes 350 are separated from the injection hole groups 30 in the radial direction. The through-holes 350 extend in the axial direction. That is, the through-holes 350 extend in parallel to the slit 50. However, the present disclosure is not limited thereto, and the through-holes 350 may extend in a direction oblique to the axial direction.

As illustrated in FIG. 11, the plurality of through-holes 350 are formed in the radial direction. However, the present disclosure is not limited thereto, and only one through-hole 350 may be formed in the radial direction. Further, the plurality of through-holes 350 are formed at equal intervals in the circumferential direction of the burner plate 314*a*. However, the present disclosure is not limited thereto, and the plurality of through-holes 350 may be formed at unequal intervals in the circumferential direction. The plurality of through-holes 350 allow communication between the space S and the cavity 250A. The plurality of through-holes 350 are displaced in the radial direction with respect to the slit 50. That is, the plurality of through-holes 350 are formed at positions offset from the slit 50 in the radial direction.

According to the third modification example, the plurality of through-holes 350 can supply the air in the space S into the cavity 250A. This enables an interior of the cavity 250A to be cooled and the burner plate 314*a* to be cooled.

Further, the plurality of through-holes 350 are displaced in the radial direction with respect to the slit 50, and hence the air having passed through the through-holes 350 cannot be easily introduced directly into the slit 50. Accordingly, the air having passed through the through-holes 350 can be collided with an inner wall surface of the burner plate 314*a* that defines the cavity 250A. As a result, cooling of the burner plate 314*a* can be accelerated, and hence the melt loss of the burner plate 314*a* can be suppressed.

Further, the air supplied into the cavity 250A is supplied into the combustion chamber 13*c* via the slit 50. Accordingly, hydrogen flame formed near the burner plate 314*a* in the combustion chamber 13C can be prevented from approaching the burner plate 314*a*, and hence the melt loss of the burner plate 314*a* can be suppressed.

An embodiment of the present disclosure has been described above with reference to the attached drawings, but, needless to say, the present disclosure is not limited to the above-mentioned embodiment. It is apparent that those skilled in the art may arrive at various alterations and modifications within the scope of claims, and those examples are construed as naturally falling within the technical scope of the present disclosure.

There has been described above the example in which the rotational power generated by the turbocharger 11 is used as energy for driving the power generator 12 in the gas turbine system 1. However, the present disclosure is not limited thereto. For example, the combustion device 10 in the gas turbine system 1 may be applied to other combustion devices, such as a jet engine and an industrial furnace. Further, in the gas turbine system 1, the rotational power generated by the turbocharger 11 may be used for other purposes (e.g., for driving a moving object such as a ship).

There has been described above the example in which the shape of the combustion chamber 13*c* is a substantially cylindrical shape. However, the shape of the combustion chamber 13*c* is not limited to this example. For example, the combustion chamber 13*c* may be a space having a substantially truncated cone shape. The shapes of the burner plates 14*a*, 114*a*, 214*a*, and 314*a* may be modified as appropriate in accordance with the shape of the combustion chamber 13*c*.

In the example of FIG. 1 described above, the air fed from the compressor 11*a* to the combustor 13 is fed into the combustion chamber 13*c* after passing between an outer peripheral surface of the liner 13*b* and an inner peripheral surface of the casing 13*a*. However, the path of air fed from the compressor 11*a* to the combustor 13 is not limited to this example (i.e., turn-flow type).

There has been described above the example in which the burner plates (plates) 14*a*, 114*a*, 214*a*, and 314*a* are utilized in the gas turbine system 1. However, the burner plates 14*a*, 114*a*, 214*a*, and 314*a* may be utilized for systems other than the gas turbine system 1. For example, the burner plates 14*a*, 114*a*, 214*a*, and 314*a* may be used as heat transfer plates in which flow passages for allowing water distribution are formed.

There has been described above the example in which the burner plates 14*a*, 114*a*, 214*a*, and 314*a* supply hydrogen into the combustion chamber 13*c*. However, the fuel to be supplied by the burner plates 14*a*, 114*a*, 214*a*, and 314*a* into the combustion chamber 13*c* is not limited to hydrogen, but may be, for example, natural gas.

What is claimed is:

1. A combustion device, comprising:

a plate facing a combustion chamber;

a plurality of injection hole groups formed in the plate so as to have an annular shape;

a slit having an annular shape and formed between the plurality of injection hole groups;

an annular cavity that is formed between the plurality of injection hole groups in the plate, and communicates with the slit; and a through-hole that is formed in the plate on a side opposite to the combustion chamber, and communicates with the annular cavity, wherein the plurality of injection hole groups include a first injection hole group and a second injection hole group, wherein each of the first injection hole group and the second injection hole group includes:

a plurality of fuel injection holes facing an interior of the combustion chamber and formed so as to be spaced apart from each other in a circumferential direction of the combustion chamber;

a first air injection hole having an annular shape, facing the interior of the combustion chamber, and extending in the circumferential direction on a radially outer side with respect to the plurality of fuel injection holes; and a second air injection hole having an annular shape, facing the interior of the combustion chamber, and extending in the circumferential direction on a radially inner side with respect to the plurality of fuel injection holes, and wherein the second injection hole group is located radially inward of the first injection hole group.

2. The combustion device according to claim 1, wherein the through-hole is displaced in a radial direction with respect to the slit.

3. The combustion device according to claim 1, further comprising:

a casing;

a liner provided in an interior of the casing, the combustion chamber being formed in an interior of the liner; and a space surrounded by the liner, the plate and the casing, wherein the slit is formed on the plate between the plurality of injection hole groups, and wherein the slit faces the combustion chamber, and does not face the space.

4. A gas turbine system, comprising the combustion device of claim 1.

5. A combustion device, comprising:

a plate facing a combustion chamber;

a plurality of injection hole groups formed in the plate so as to have an annular shape;

a slit having an annular shape and formed between the plurality of injection hole groups;

an annular cavity that is formed between the plurality of injection hole groups in the plate, and communicates with the slit; and a through-hole that is formed in the plate on a side opposite to the combustion chamber, and communicates with the annular cavity, wherein the plurality of injection hole groups include a first injection hole group and a second injection hole group, wherein each of the first injection hole group and the second injection hole group includes:

a plurality of fuel injection holes facing an interior of the combustion chamber and formed so as to be spaced apart from each other in a circumferential direction of the combustion chamber; and at least one air injection hole having an annular shape, facing the interior of the combustion chamber, and extending in the circumferential direction on at least one of a radially outer side and a radially inner side with respect to the plurality of fuel injection holes, and wherein the at least one air injection hole is inclined, with respect to an axial direction of the combustion chamber, toward the plurality of fuel injection holes in a radial direction.

6. The combustion device according to claim 5, wherein the through-hole is displaced in a radial direction with respect to the slit.

7. The combustion device according to claim 5, further comprising:

a casing;

a liner provided in an interior of the casing, the combustion chamber being formed in an interior of the liner; and a space surrounded by the liner, the plate and the casing, wherein the slit is formed on the plate between the plurality of injection hole groups, and wherein the slit faces the combustion chamber, and does not face the space.

8. A gas turbine system, comprising the combustion device of claim 5.

* * * * *